United States Patent [19]

Ostroll

[11] 3,949,914

[45] Apr. 13, 1976

[54] SIZE MARKER ASSEMBLY

[75] Inventor: Henry D. Ostroll, Jackson Heights, N.Y.

[73] Assignee: J. C. Penney Company, Inc., New York, N.Y.

[22] Filed: Feb. 7, 1975

[21] Appl. No.: 548,449

[52] U.S. Cl. ..... 223/85; 40/322

[51] Int. Cl.[2] ..... A47J 51/098

[58] Field of Search ..... 223/85, 88, 89, 90, 91, 223/92, 93, 94; 211/113; 40/322

[56] References Cited

UNITED STATES PATENTS

| | | | |
|---|---|---|---|
| 1,099,261 | 6/1914 | Lewyt | 40/322 X |
| 1,142,720 | 6/1915 | McAuley | 40/322 |
| 1,389,266 | 8/1921 | Newton | 40/322 |
| 1,710,296 | 4/1929 | Clark | 40/322 |
| 2,658,627 | 11/1953 | Magnuson | 223/85 X |

FOREIGN PATENTS OR APPLICATIONS

| | | | |
|---|---|---|---|
| 415,653 | 8/1934 | United Kingdom | 223/88 |

*Primary Examiner*—George H. Krizmanich
*Attorney, Agent, or Firm*—Pennie & Edmonds

[57] ABSTRACT

In combination, a clothing hanger having a hook portion; and a marker device which includes a marking surface adapted to carry identifiable indicia, and clasp means protruding from one side of the marking surface for detachable connection to the hook portion. The hook portion includes retaining means which, in one preferred embodiment, comprises at least one stop means which extends along at least a portion of the hook portion and is arranged for restricting uncontrolled downward movement of the marker device along the hook portion.

3 Claims, 4 Drawing Figures

SIZE MARKER ASSEMBLY

BACKGROUND OF THE INVENTION

1. Field of the Invention

The present invention is generally directed to size buttons or tallys for clothing hangers or the like. More particularly, it is directed to a new and improved combination of size marker and clothing hanger wherein the marker while not only being firmly, easily, and detachably mounted on a clothing hanger is prevented from uncontrolled sliding movement with respect to the hanger.

2. Description of the Prior Art

It is customary practice in the clothing retail industry to enable easy visual identification of the sizes of garments and the like which are appropriately mounted on clothing hangers. As is generally known, such visual identification serves to provide for quick buyer identification of the size of the garment, thereby facilitating purchase of the retail merchandize, as well as promote an efficient inventory of the same. Ordinarily, these objectives are accomplished by the so-called size buttons or tallys. Such tallys are typically removably attached to the clothing hanger and, as mentioned earlier, their identifiable indicia provide information such as clothing size and/or other pertinent types of information.

One known type of tally device, however, is arranged to cooperate with the hanger such that two opposite display panels face directly outwardly from the sides of the hanger. This particular type suffers from the disadvantage that the information displayed is not easily visible from the front of a rack upon which a plurality of clothing hangers are suitably situated. Accordingly, an individual interested in examining the tally device for the appropriate information must move the hangers sideways to do so. This aforedescribed arrangement, however, is not as satisfactory as could otherwise be provided for.

Other forms of tally devices or size markers are adapted to be detachably connected to the clothing hanger so as to facilitate the visual identification of the retailed merchandise from the front of the clothing rack. Such of these latter types, however, suffer from certain shortcomings in that they have a tendency to uncontrollably slide along the hanger and thereby be displaced from their intended position, such that they may be located in an area in which they might not be easily observed. As a consequence thereof, these latter types of tally devices fail to adequately satisfactorily perform their intended functions of enabling for quick identification.

SUMMARY OF THE INVENTION

Accordingly, therefore, it is an object of the present invention to provide a novel and improved combination of clothing hanger and size marker or tally device which is simple in construction, reliable through repeated use, and yet prevents at least an uncontrolled downward movement of the marker device.

Briefly hereinafter set forth, the present invention contemplates a unique and improved combination which essentially includes a clothing hanger and improved marker device therefor. The marker device may include resilient clasp means protruding from one side thereof for detachable connection to a standard hook portion of the hanger. Such clothing hanger has the standard hook portion which includes a first body portion having opposite sides, a second body portion connected adjacent an end of the first body portion, and retaining means. Such second body defines a pair of flanges extending generally transversely and in opposite directions from each other, such that each flange extends from respective opposite sides of the first body portion. In one preferred embodiment, the retaining means is defined by at least one stop means which extends along at least a portion of the first body portion and is generally angularly disposed with respect to one of the flanges for the purpose of restricting uncontrolled downward movement of the marker device along the flange should the marker device have a tendency to slide downwardly. Accordingly, by appropriately positioning the stop means on the hook portion below the intended position for the marker device, the operative cooperation between the clasp means of the marker device and the stop means reduces the tendency for the marker device to uncontrollably slide downwardly to a position at which it might not otherwise be readily visible. In another embodiment, the stop means is defined by two generally spaced apart and parallel stop members which define a space designed to cooperate with the clasp means of the marker device for inhibiting either upward or downward movement of the marker device.

BRIEF DESCRIPTION OF THE DRAWINGS

The above as well as other objects, features, and advantages of the present invention shall become readily apparent upon a reading of a detailed description of the preferred embodiment when viewed in conjunction with the accompanying drawings wherein like reference numerals indicate like structure throughout the several views.

DETAILED DESCRIPTION OF A PREFERRED EMBODIMENT

Figure 1:
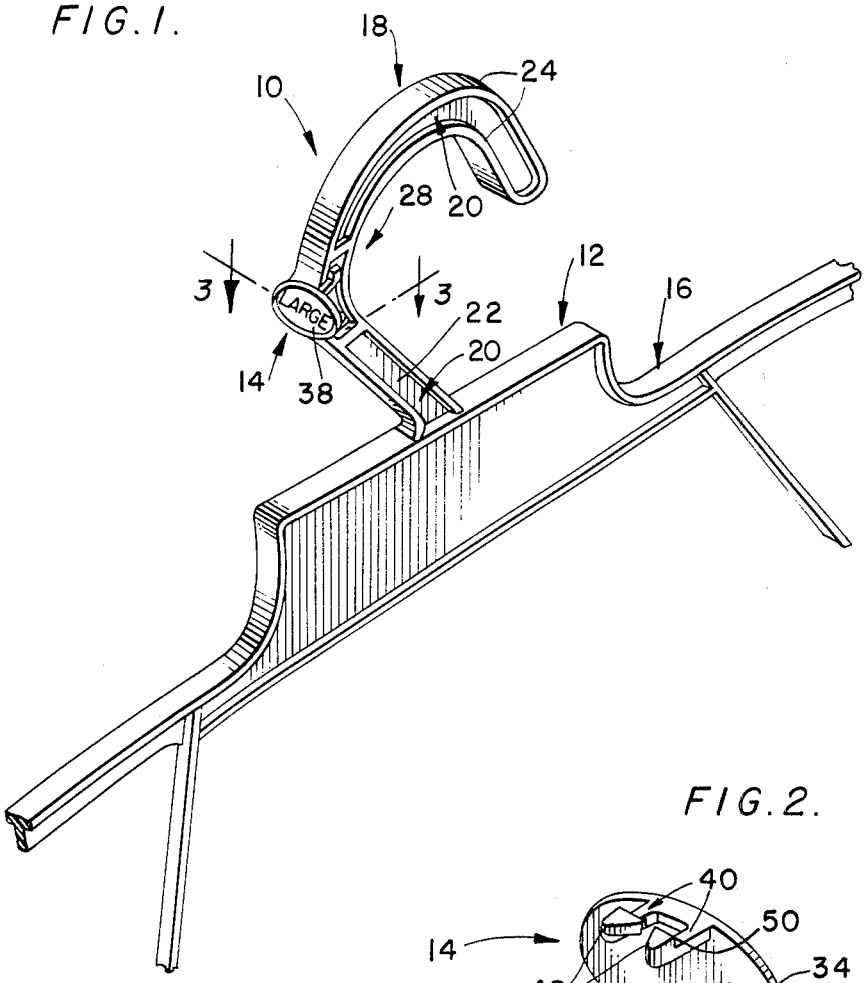
FIG. 1 is a perspective view illustrating the preferred cooperation between marker device and clothing hanger of the present invention.

With particular reference to FIG. 1, there is depicted the improved marker assembly combination of the present invention being designated generally by reference numeral 10. As clearly depicted, such marker assembly 10 is essentially comprised of an improved garment or clothing hanger means 12, and a marker device means 14 which is appropriately detachably secured to the hanger means.

With respect to the clothing hanger means 12, it will be seen to include a shoulder section 16 having extending upwardly therefrom a standard type hook portion 18. This hook portion 18, in a well-known manner, is adapted to enable the hanger 12 to be suitably suspended from a clothing rack or the like. In the particular embodiment being illustrated, the hook portion 18 includes a first generally flat main body portion 20 having opposed side surfaces 22. Formed adjacent opposite edges of the main body portion 20 are second body portions 24 which define a pair of flange sections 26 that extend generally transversely and in opposite directions from side surfaces 22 of main body portion 20. While the foregoing type of clothing hanger 12 has been disclosed it should be pointed out, however, that other forms of garment hangers 12 with different configurations are also contemplated for use in the present invention without departing from the spirit and scope thereof.

Figure 4:
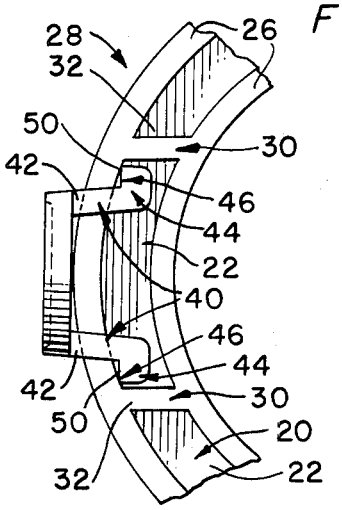
FIG. 4 is an enlarged fragmented side elevational view depicting in somewhat greater detail the operative cooperative relationship between the marker device and hook portion of the clothing hanger.

As perhaps more precisely depicted in FIG. 1 taken in conjunction with FIG. 4, there is shown retaining means 28 of the preferred embodiment. Such retaining means 29 may include one but, preferably, two stop means 30. As illustrated, the stop means 30 may be defined by two spaced apart and parallel, generally elongated stop members or rib portions 32. These rib portions 32 may be integrally or otherwise formed or attached as part of the hanger means 12 and are so situated as to be generally transverse to and between flange sections 26. As depicted, the spacing between rib portions 32 is such as to accommodate the marker means 14, in a manner to be more fully described. As will become evident in the succeeding description, the general angular orientation of rib portions 32 to the flanges may of, course, vary so long as they serve the purpose of preventing undesired movement of the marker device 14.

Essentially, such rib portions 32 are spaced by a distance which restricts uncontrolled sliding movement of the marker means 14 whenever the latter is appropriately detachably secured thereto. By this particular arrangement, the marker device 14 will be prevented from sliding upwardly or downwardly relative to the hook portion 18. Accordingly, it is restricted from assuming unintended positions which might be difficult to observe by a customer or the like. such aforenoted spacing between rib portions 32 may, of course, be varied so long as they serve to prohibit displacement of the marker device 14 to positions whereat they would be difficult to observe on the hook portion 18. Of course, it is well within the spirit and scope of the present invention that only one of the rib portions 32 be provided. Ordinarily, the bottom rib portion 32 would be provided so as to at least inhibit the undesired uncontrolled downward movement of marker device 14. Although continuous rib portions 32 have been disclosed between flanges 26, such portions may be of any size and configuration, so long as they are able to restrict uncontrolled downward movement of the marker device to thereby retain the intended position of the latter.

With continued reference to FIGS. 1 to 4, the marker device or tally means 14 of the present invention basically includes a main marker body portion 34 and clasp means 36. The marker body portion 34 may have any desired configuration, such as a generally flat and oval shape. As best illustrated in FIG. 1, the marker body portion 34 has a marking or display surface 38. Such display surface 38 is, of course, adapted to receive thereon a suitable indicia display which may indicate size of the clothing which is intended to be placed on hanger 12.

Figure 2:
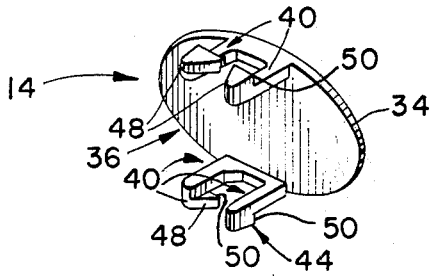
FIG. 2 is a perspective view depicting the rearward side of the marker device of the present invention and showing greater details thereof.
Figure 3:
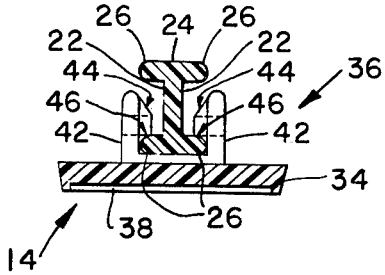
FIG. 3 is a sectional view taken substantially along section line 3—3 appearing in FIG. 1 looking in the direction of the arrows and illustrating the manner by which the marker means of the present invention is detachably secured to the hook portion of the hanger.

As more clearly denoted in FIG. 2, the clasp means 36 of this particular embodiment is defined by opposed pairs of generally elongated and resilient clasping members 40. Such clasp members 40 are integrally connected to and protrude in one direction from the rear of marker body portion 34. The clasping members 40 are, in a manner to be afterwards more fully described, removably attached to the hanger means 12. To facilitate such selective attachment, the clasping members 40 should be made of a material which possesses some resiliency for purposes presently described. Each clasping member 40 is defined by a generally elongated stem portion 42 which terminates in a camming means 44 and a latching means 46. The camming means 44 is defined by a generally wedge shaped member having an inclined camming surface 48 which is adapted to engage the hanger means 12. The camming surface 48 of the respective pairs of clasping members 40 are spaced from each other by a distance which is less than the dimension of the second body portions 24 which define the flange portions 26 for purposes subsequently made evident. Latch means 46 may be defined by a generally flat latching surface 50 which is designed to catch the inward surface of the flange 26, much as in the manner best indicated in FIG. 3.

By virtue of the aforenoted structural arrangement, it will be appreciated that whenever it is desired to attach marker device 14 to the hanger means 12, one merely has to force the clasping members 40 toward the hanger means 12 until the camming surfaces 48 are brought into engagement with the flanges 26. Since, as previously mentioned, the clasping members 40 possess some resiliency they are spread apart until they pass over the flanges 26. Thereafter, the latch surfaces 50 will snap back, by reason of the preformed bias of the clasping members 40, to generally straight positions, whereby latch surfaces 50 will tightly frictionally engage the inside surface of flanges 26. To remove the clasping members 40 from the hanger means 12 it is only necessary to pull the marker device 14 from the hook portion 18. The foregoing operation is facilitated by the aforenoted preformed resiliency of the clasping members 40. As indicated earlier, by placing the marker device 16 between the rib portions 32, the former will be restricted from uncontrolled displacement in either of two directions. Accordingly, the marker assembly construction 10 is, therefore, able to retain the marker device 12 in its intended location. Consequently, such marker device 12 will not be able to slide to other undesirable positions whereat it might not be easily visible.

While the invention has been described with a preferred embodiment, it is not intended to limit the invention to the particular form set forth, but, on the contrary, it is intended to cover such alternatives, modifications, and equivalents as may be included within the spirit and scope of the invention as defined by the appended claims.

What is claimed is:

1. In combination, a clothing hanger means having a hook portion; and a marker device which includes a marking surface adapted to carry identifiable indicia, and clasp means protruding from one side of the marking surface for detachable connection to the hook portion, said hook portion including retaining means, said retaining means includes at least one laterally protruding stop means which extends along at least a portion of said hook portion and is arranged for restricting uncontrolled downward movement of the marker device along the hook portion.

2. In combination, a clothing hanger means having a hook portion; and a marker device means including a marking surface adapted to carry indicia, and clasp means protruding from one side of said marking surface for detachable connection to said hook portion, said hood portion including a first body portion having opposite sides, a second body portion connected adjacent an end of said first body portion which defines a pair of flanges extending generally transversely and in opposite directions from each other such that each flange extends from respective opposite sides of said first body portion, and retaining means including two spaced apart and generally parallel stop means which extend along at least a portion of said first body portion and being generally angularly disposed with respect to at least one of said flanges for preventing uncontrolled upward or downward movement of said marker means along said flange.

3. In combination, a clothing hanger means having a hook portion, and a marker device means including a marking surface adapted to carry indicia, and clasp means protruding from one side of said marking surface for detachable connection to said hook portion, said hook portion including retaining means including two spaced apart stop means which extend along at least a portion of said hook portion for preventing uncontrolled upward or downward movement of said marker means along said hook portion.

* * * * *